US006772043B1

(12) United States Patent
Zagnoni et al.

(10) Patent No.: US 6,772,043 B1
(45) Date of Patent: Aug. 3, 2004

(54) APPARATUS FOR AUTOMATICALLY CONTROLLING THE WORK FLOW OF AN AUTOMATIC WRAPPING MACHINE, IN PARTICULAR FOR ROLLS OF PAPER

(75) Inventors: Cristian Zagnoni, Calcara Di Crespellano (IT); Tiziano Gasperini, Bologna (IT)

(73) Assignee: T.M.C., S.p.A., Bologna (IT)

( * ) Notice: Subject to any disclaimer, the term of this patent is extended or adjusted under 35 U.S.C. 154(b) by 0 days.

(21) Appl. No.: 10/358,730

(22) Filed: Feb. 5, 2003

(51) Int. Cl.[7] ..... G06F 19/00

(52) U.S. Cl. ..... 700/193; 700/186; 700/188; 53/203

(58) Field of Search ..... 53/52, 203, 218, 53/232, 255, 372.6; 229/900, 87.01; 700/186, 188, 192–193

(56) References Cited

U.S. PATENT DOCUMENTS

| | | | | | |
|---|---|---|---|---|---|
| 4,467,973 | A | * | 8/1984 | Iwata | 242/437.1 |
| 4,514,181 | A | * | 4/1985 | Hughes | 493/131 |
| 4,514,955 | A | * | 5/1985 | Mouser et al. | 53/64 |
| 4,629,956 | A | * | 12/1986 | Nozawa et al. | 318/625 |
| 4,885,515 | A | * | 12/1989 | Kurakake et al. | 318/567 |
| 4,959,600 | A | * | 9/1990 | DiGiulio et al. | 318/625 |
| 5,179,815 | A | * | 1/1993 | Cahill et al. | 53/133.3 |
| 5,946,884 | A | * | 9/1999 | Nordstrom et al. | 53/225 |
| 5,987,847 | A | * | 11/1999 | Nordstrom et al. | 53/234 |
| 6,118,271 | A | * | 9/2000 | Ely et al. | 324/207.17 |
| 6,192,656 | B1 | * | 2/2001 | Takahashi | 53/409 |
| 6,225,772 | B1 | * | 5/2001 | Aizawa et al. | 318/571 |
| 6,519,860 | B1 | * | 2/2003 | Bieg et al. | 33/503 |
| 6,705,060 | B1 | * | 3/2004 | McGuinness et al. | 53/409 |
| 2004/0011002 | A1 | * | 1/2004 | Sendo et al. | 53/234 |

* cited by examiner

*Primary Examiner*—Leo Picard
*Assistant Examiner*—Alexander Kosowski
(74) *Attorney, Agent, or Firm*—Fay, Sharpe, Fagan, Minnich & Mckee, LLP

(57) ABSTRACT

An apparatus for automatically controlling the work flow of a machine—equipped with effectors (2) driven by rotational motors (12)—comprises: electronic storage means (11) having resident functions that relate the angle of rotation described by a controlling motor (12) with the desired instantaneous position of a controlled effector (2); means (13) for detecting the actual instantaneous position of the controlled effector (2); comparator means (14) for determining the positional error of the controlled effector (2) relative to a given expected position upon reaching a certain angle of rotation of the controlling motor (12); and means **(15*a*) for controlling the motor (12) of the controlled effector (2), which receive the error signal from the comparator means (14) and apply to the motor (12) a corresponding corrective action designed to control and synchronize the angular position of the controlled motor (12) with that of the controlling motor (12)**.

35 Claims, 3 Drawing Sheets

Motor
a°,b°,c°,c1°,
d°,e°,f°,g°,
i°,j°,m°,n°
Amplifier
D/A
mP
Encoder
INTERFACE
EPROM
RAM
CPU
TERMINALS
H, L
1
2
5
6
7
8
10
11
12
13
14-15a
15
16
20
20a
20b
25
30

APPARATUS FOR AUTOMATICALLY CONTROLLING THE WORK FLOW OF AN AUTOMATIC WRAPPING MACHINE, IN PARTICULAR FOR ROLLS OF PAPER

BACKGROUND OF THE INVENTION

The present invention relates to the automatic wrapping of cylindrical products, such as rolls of toilet or kitchen paper, in sheets of plastic film suitably folded and sealed in direct contact with the rolls. More specifically, the invention relates to an apparatus for automatically controlling the work flow of a wrapping machine of the type just mentioned.

Automatic wrapping machines of this kind are normally equipped with a set of effectors, that is to say, different parts used to perform the different steps of the operating cycle. These effectors include: an elevator having a table that is reciprocatingly movable in a vertical direction between a lowered position, in which it receives the products to be wrapped, and a raised position, in which the products are positioned inside a wrapping station; a pair of planar horizontal folders located under the wrapping station on each side of a vertical, central machine axis, the pair of planar horizontal folders being reciprocatingly movable in reciprocally opposite horizontal directions; and two pairs of planar vertical, parallel folders, located on each side of the wrapping station and being reciprocatingly movable in reciprocally opposite horizontal directions; the machine being also equipped with a plurality of pushers positioned in succession at equal intervals along a horizontal direction passing through the wrapping station, the pushers being designed to accommodate the products in pairs and to feed them in the horizontal direction, and with rotational motors for driving the effectors.

During the process cycle, the duration of every physical event performed by the effectors corresponds to a certain angle of rotation traveled by the related drive motor or, otherwise, to an angle of rotation traveled by a controlling motor with which the effector drive motors are synchronized and to which they are hierarchically subordinated.

It is therefore possible to set the steps, advances and delays of the effectors in accordance with the angles traveled by the controlling motor and to create a work flow in which all the operating steps are correlated in the required sequence.

In machines of the aforementioned kind, the work flow is based on a product-specific work flow diagram where the angular values determining the transitions from one step to another, once defined and optimized for a specific product, are kept fixed and are invariable over time.

As a general rule, the adaptation of an automatic machine to operate on the basis of a different work flow diagram is possible but requires lengthy and laborious set-up operations, which means that, normally, each machine is used to wrap a single type of product, thus operating according to a rigid automation system.

In practice, a user who does not possess a different machine for each different product but nevertheless wishes to wrap different products, after establishing the geometrical compatibility between machine and product, continues to use the same work flow even for products different from the product for which the machine's work flow was originally designed, without making any adaptations to improve the work flow in relation to the product being wrapped.

This leads to two orders of problems: the first is linked to economy of production in terms of unit product cost and machine productivity; the second is linked to the construction and operating costs of the machine itself. Indeed, in the former case, the time scale of the production cycle remains unchanged even when wrapping smaller products, which is obviously anti-economic. Furthermore, since the operating steps follow each other in sequence and at different angular (and time) intervals, the work flow inevitably involves stopping some of the effectors and thus braking the related drive motors. This repeated stopping and starting eventually leads to excessive wear of some of the motors, caused especially by overheating, creating limits on production due essentially to the fact that a few, or even just one, of the drive motors reach critical conditions before the others.

SUMMARY OF THE INVENTION

The present invention has for an object to overcome the above mentioned disadvantages by providing a control apparatus capable of intelligently controlling the different operating conditions of different motors, which are driven at instantaneously variable speeds subject only to the requirement of satisfying certain conditions essential to the correct performance of the process cycle.

In accordance with the invention, the above object is achieved by an apparatus for automatically controlling the work flow of a machine as described in the preamble to claim 1, the apparatus comprising: electronic storage means having resident functions that relate the angle of rotation described by a controlling motor with the desired instantaneous position of a controlled effector; means for detecting the actual instantaneous position of the controlled effector; comparator means for determining the positional error of the controlled effector relative to a given expected position upon reaching a certain angle of rotation of the controlling motor; and means for controlling the motor of the controlled effector, which receive the error signal from the comparator means and apply to the motor a corresponding corrective action designed to control and synchronize the angular position of the controlled motor with that of the controlling motor.

If the resident functions are embodied as a discrete set of control conditions, the apparatus can be used to implement a sort of discontinuous, point-to-point control system of the machine's work flow.

Further, if these control conditions are defined as functions of absolute elements—outside the machine—and relating, for example, to the characteristic dimensions of the product or of the corresponding package, the control apparatus, if appropriately interfaced with the wrapping machine, permits flexible control of work flows optimized for each type of product and, hence, flexible control of a traditional machine.

BRIEF DESCRIPTION OF THE DRAWINGS

The technical characteristics of the invention, with reference to the above aims, are clearly described in the claims below and its advantages are apparent from the detailed description which follows, with reference to the accompanying drawings which illustrate a preferred embodiment of the invention provided merely by way of example without restricting the scope of the inventive concept, and in which:

DESCRIPTION OF THE PREFERRED EMBODIMENTS

Figures 1, 2:
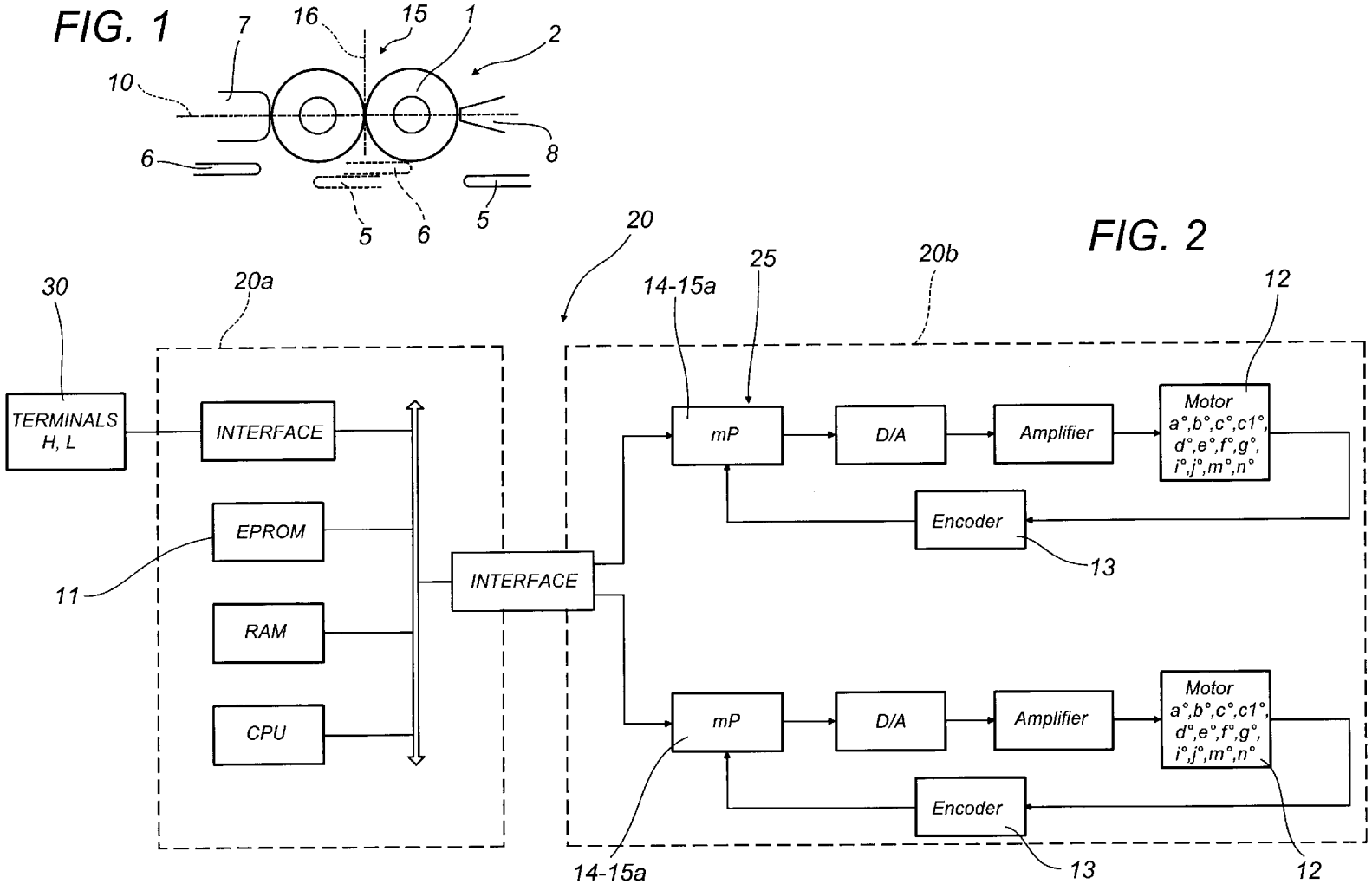
FIG. 1 is a schematic representation of some typical effectors of an automatic machine for wrapping cylindrical products, such as rolls of paper.
FIG. 2 is a functional block diagram of an apparatus for controlling the machine of FIG. 1.

With reference to FIG. 2 of the accompanying drawings, the numeral 20 denotes in its entirety an apparatus for controlling the work flow of an automatic machine for wrapping products 1, in particular cylindrical products, such as rolls of toilet or kitchen paper, in packs of different sizes.

The wrapping machine, to which the control apparatus 20 is connected, is well within the knowledge of one of ordinary skill in the art and, since it does not strictly form part of the invention, is represented very schematically in FIG. 1 only insofar as concerns the parts of it that are relevant to the apparatus according to the invention.

More specifically, the machine is equipped (FIG. 1) with a set of effectors, generically labeled 2 in their entirety, which functionally cooperate with each other and which are driven by rotational drive motors 12. The effectors 2 include in particular: an elevator 3; a pair of planar horizontal folders 5, 6; two pairs of planar vertical folders 7, 8; and a plurality of pushers 9.

The elevator 3 has a horizontal table 4 that is reciprocatingly movable in a vertical direction between a lowered position, in which it receives the products 1 to be wrapped, and a raised position, in which the products 1 are positioned inside a wrapping station 15 forming part of the wrapping machine.

The two planar horizontal folders 5, 6 are located under the wrapping station 15 on each side of a vertical, central machine axis 16 of the wrapping station 15. These planar horizontal folders 5, 6 are reciprocatingly movable in reciprocally opposite horizontal directions towards and away from the machine axis 16.

The four planar vertical folders 7, 8 are positioned in two by two, parallel fashion on each side of the wrapping station 15 and are reciprocatingly movable also in reciprocally opposite horizontal directions.

The pushers 9 consist of long, vertical elements mounted on a horizontal chain conveyor (not illustrated) and are positioned in succession at equal intervals along a horizontal direction 10 passing through the wrapping station 15, accommodating the products 1 in pairs while they are being wrapped and feeding them in the horizontal direction 10.

The wrapping machine control apparatus 20—schematically represented in FIG. 2—essentially comprises two component structures 20*a*, 20*b*, which are mutually interfaced and hierarchically dependent, the former having supervisory functions and the latter being designed to interact directly with the motors 12 of the effectors 2.

More specifically, the apparatus 20 comprises: electronic storage means 11 in which there are resident functions for controlling the machine's work flow; means 13 for detecting the actual instantaneous position of the controlled effectors 2; comparator means 14 for determining the positional error of each controlled effector 2; and means 15*a* for controlling the drive motor 12 of each controlled effector 2.

The control functions residing in the electronic storage means 11 relate the angle of rotation a°, b°, c°, c°, d°, e°, f°, g°, i°, j°, m°, n° describedby a controlling motor 12 with the desired instantaneous position of a controlled effector 2, in order to synchronize all the effectors 2 during the performance of the process cycle.

The detecting means 13—embodied, for example, as encoders associated with the controlling motor 12 of each effector 2—send feedback to local processing means 25 which they are connected to.

The local processing means 25—embodied, for example, as a microprocessor or as an equivalent dedicated electronic card—are equipped with comparator means 14 and means 15*a* for controlling the motors 12 of the effectors 2.

The comparator means 14 determine the positional error of the controlled effector 2 relative to a given expected position upon reaching a certain angle of rotation of the controlling motor 12.

The control means 15*a*, receive the error signal as input from the comparator means 14 and, after suitable processing, apply to the motor 12 a corresponding corrective action designed to control and synchronize the angular position of the controlled motor 12 with that of the controlling motor 12.

More specifically, the control functions define a discrete set of control conditions determined as functions of parameters relating to the dimensions of the product 1 to be wrapped.

Figure 3:
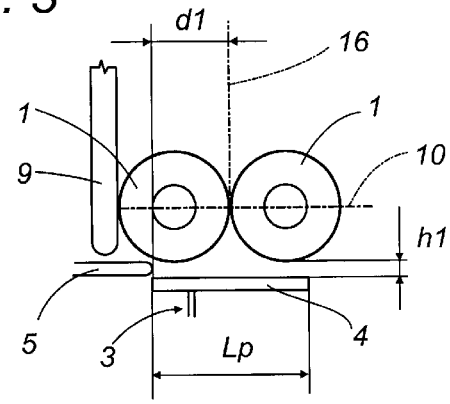
FIGS. 3 to 12 are schematic representations of some of the control conditions established between the effectors of the machine of FIG. 1.

FIG. 3 schematically illustrates an operating condition of the machine that graphically represents a first control condition established between the position of the first planar horizontal folder 5, which is driven towards the machine axis 16 starting from an initial position in which it is away from the axis 16, and the position of the elevator 3 table 4 which, instead, moves away from the wrapping station 15 longitudinally along the machine axis 16.

The control condition consists in measuring the angle of rotation a° of the controlling motor 12 when the table of the elevator 3 has moved down, away from the wrapping station 15, by a defined vertical distance h1 and checking that the first planar horizontal folder 5 is at that instant located at a defined horizontal distance d1 from the machine axis 16 in such a way as to receive the load of the products 1, previously supported by the table 4 of the elevator 3.

The distance h1 is nearly equal to the thickness of the first planar horizontal folder 5. At the same time, the horizontal distance d1 is substantially equal to Lp/2, where Lp is the width of the table of the elevator 3 measured parallel with the product 1 feed direction in the wrapping station 15.

The same control condition also establishes a correlation between the above mentioned position of the first planar horizontal folder 5 and the position of a pusher 9 which must, at the same instant, be touching the back of one of the products 1 located inside the wrapping station 15.

Figure 4:
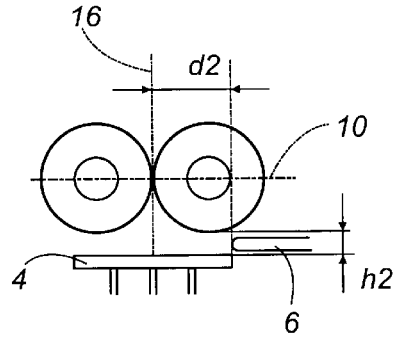

A second control condition—schematically represented in FIG. 4—is established between the position of the second planar horizontal folder 6, which is driven towards the machine axis 16 starting from an initial position in which it is away from the machine axis, and the position of the elevator 3 table 4 which is moved away from the wrapping station 15 longitudinally along the machine axis 16. The control condition consists in measuring the angle of rotation b° of the controlling motor 12 when the table 4 has moved down a defined distance h2 vertically away from the wrapping station 15, and checking that the second planar horizontal folder 6 is at that instant located at a defined distance d2 from the machine axis 16.

The distance h2 is slightly greater than the sum of the thickness of the first planar horizontal folder 5 plus the thickness of the second planar horizontal folder 6.

The distance d2 is equal to Lp/2, where Lp is the width of the table 4 of the elevator 3 measured parallel with the product 1 feed direction in the wrapping station 15.

Figure 5:
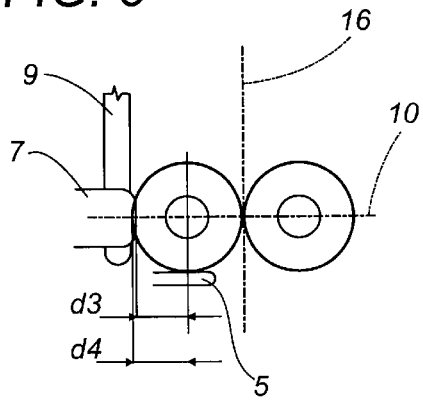

A third control condition—schematically represented graphically in FIG. 5—is established between the position of the first planar horizontal folder 5, which is driven towards the machine axis 16 starting from an initial position in which it is away from the machine axis, and the position of the product 1 pusher 9 which is moved in the horizontal feed direction 10. The control condition consists in measuring the angle of rotation c° of the controlling motor 12 when the first planar horizontal folder 5 has moved past the current position of the pusher 9 by a defined distance d3, and checking that the first planar horizontal folder 5 has at the same time moved past the first planar vertical folder 7 by a defined distance d4 measured along the horizontal direction 10 in which the products 1 are fed in the wrapping station 15.

The distance d3 is substantially equal to one half of the overall dimension of the product 1 measured parallel with the horizontal feed direction 10. The distance d4 is also substantially equal to one half of the overall dimension of the product 1 measured parallel with the horizontal feed direction 10.

Figure 6:
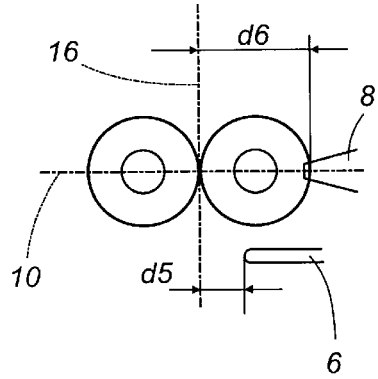

A fourth control condition—schematically represented in FIG. 6—is established between the position of the second planar horizontal folder 6 and the position of the second planar vertical folder 8, both moving towards the machine axis 16. The control condition consists in measuring the angle of rotation c1° of the controlling motor 12 when the second planar horizontal folder 6 is located at a defined distance d5 from the machine axis 16 and the second planar vertical folder 8 is at a defined distance d6 from the machine axis 16.

The distance d5 is approximately equal to Lp/2, where Lp is the width of the table 4 of the elevator 3 measured parallel with the horizontal feed direction 10 of the products 1. The distance d6 is approximately equal to L/2 where L is the distance between two consecutive pushers 9.

Figure 7:
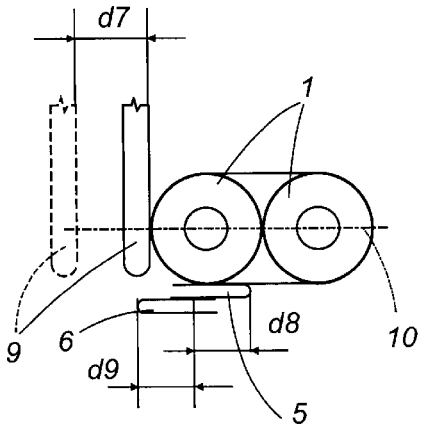

A fifth control condition—schematically represented graphically in FIG. 7—is established between the position of a pusher 9 touching a product 1 in the wrapping station 15 and the first and second planar horizontal folders 5, 6 moving towards the machine axis 16 and past the machine axis 16 itself. The control condition consists in measuring the angle of rotation d° of the controlling motor 12 when the pusher 9 has moved a defined distance d7 towards the machine axis 16 and checking that, at the measured angle d°, the first and second planar horizontal folders 5, 6 have moved past the machine axis 16 by defined distances d8 and d9, respectively.

Excluding a predetermined constant K1 dependent on the constructional characteristics of the machine, the distance d7 is substantially equal to L/4 where L is the distance between two consecutive pushers 9 in the horizontal feed direction 10 of the products 1. In the embodiment illustrated, the constant K1 is preferably 40 mm and the distance d7 is therefore L/4+40 mm.

The distances d8 and d9 are almost identical and are substantially equal to one half of the overall dimension of the product 1 measured parallel with the horizontal direction 10 in which the products 1 are fed. The distances d8 and d9 also correspond to the end-of-stroke positions of the planar horizontal folders 5 and 6 and are the same both in a "single-channel" machine such as that of the embodiment being described and in a "multi-channel" machine having a plurality of parallel lines for wrapping the products 1.

Figure 8:
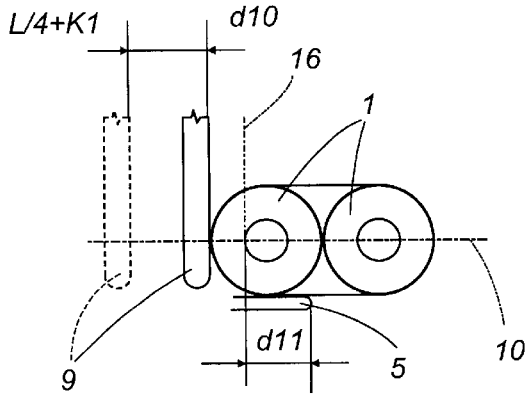

A sixth control condition—represented in FIG. 8—is established between the translational motion of a pusher 9 in contact with a product 1 in the wrapping station 15 and the position of the first planar horizontal folder 5 moving away from the machine axis 16 starting from an initial position where the first planar horizontal folder 5 was past the axis 16 and on the other side of it. The control condition consists in measuring the angle of rotation e° of the controlling motor 12 when the pusher 9 has moved a defined distance d1O away from its starting position and checking that, at the measured angle e°, the first planar horizontal folder 5 has moved past the machine axis 16 by a defined distance d11.

Excluding a predetermined constant K1, the distance d1O is substantially equal to L/4 where L is the distance between two consecutive pushers 9. The distance d11 is substantially equal to one half of the overall dimension of the product 1 measured parallel with the horizontal direction 10 in which the products 1 are fed.

Figure 9:
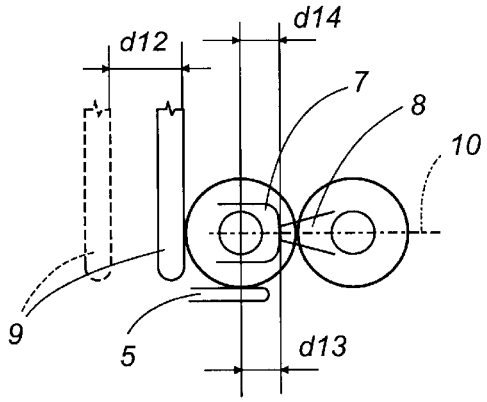

A seventh control condition—schematically represented graphically in FIG. 9—is established between the position of a pusher 9 touching a product 1 in the wrapping station 15, the position of the first planar vertical folder 7 moving forward longitudinally in the horizontal feed direction 10, and the position of the second planar vertical folder 8 moving forward in the direction 10. The control condition consists in measuring the angle of rotation f° of the controlling motor 12 when the pusher 9 has moved a distance d12 away from its starting position and checking that, at the measured angle f°, the first planar vertical folder 7 and the second planar vertical folder 8 have moved defined distances d13, d14 from the machine axis 16.

Excluding a constant K2, the distance d12 is equal to L/8 where L is the distance between two consecutive pushers 9 in the horizontal feed direction 10 of the products 1.

The distance d13 corresponds to the end-of-stroke position of the first planar vertical folder 7. The distance d14 corresponds to the end-of-stroke position of the second planar vertical folder 8. The distances d13 and d14 are approximately equal to ⅜ L where L is the distance between two consecutive pushers 9.

Figure 10:
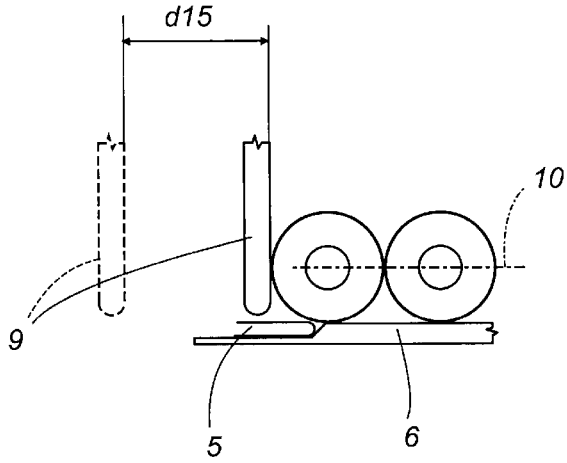

An eighth control condition—schematically represented in FIG. 10—is established between the translational motion of a pusher 9 acting on a product 1 in the wrapping station 15 and the position of the second planar horizontal folder 6, which, starting from an initial position in which it was past the axis 16 and on the other side of it, is moving back, away from the machine axis 16. The control condition consists in measuring the angle of rotation g° of the controlling motor 12 when the pusher 9 has moved a distance d15 away from its starting position where it was in contact with the product 1, and checking that, at the measured angle g°, the second planar horizontal folder 6 is just beginning to move away from the machine axis 16.

Excluding a constant K3, the distance d15 is equal to L/4 where L is the distance between two consecutive pushers 9.

Figure 11:
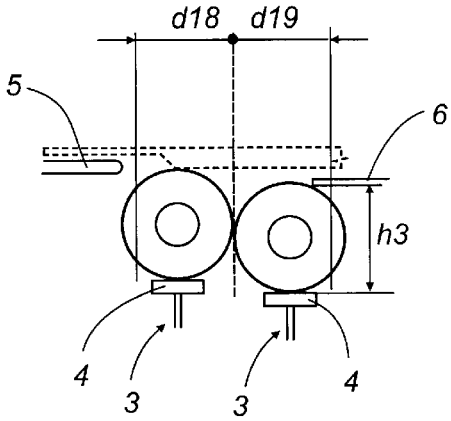

A ninth control condition—schematically represented in FIG. 11—is established between the positions of the first and second planar horizontal folders 5, 6 as they move away from each other and away from the machine axis 16, and while the table of the elevator 3 is moving upwards towards the wrapping station 15. The control condition consists in measuring the angles of rotation i°, j° of the controlling motor 12 when the table 4 of the elevator 3 has moved down, away from the wrapping station 15, by a defined vertical distance h3, and checking that, at the measured angles i°, j°, the first and second planar horizontal folders 5, 6 are at defined distances d18, d19 from the machine axis 16. Obviously, the vertical distance h3 varies according to the size of the products 1, that is to say, according to their dimension H.

The distance d18, when the table of the elevator 3 is below the first planar horizontal folder 5 by a vertical distance H, is approximately equal to L/2, where L and H are the distance between two consecutive pushers 9 and the height of the product 1, respectively.

The distance d19, when the table of the elevator 3 is below the second planar horizontal folder 6 by a vertical distance H, is approximately equal to L/2, where L and H are the distance between two consecutive pushers 9 and the height of the product 1, respectively.

Figure 12:
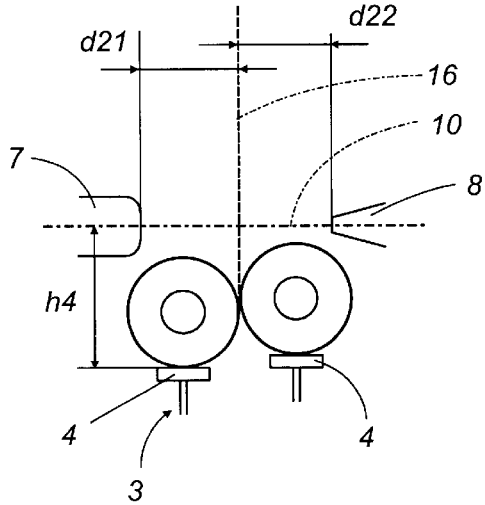

A tenth control condition—schematically represented in FIG. 12—is established between the respective positions of the first and second planar vertical folders 7, 8 as they move away from the machine axis 16; and the upward motion of the table of the elevator 3 towards the wrapping station 15. This control condition consists in measuring at least one of the angles of rotation m°; n° of the controlling motor 12 when the table 4 of the elevator 3 is located at a defined vertical distance h4 from the lower edge of the planar vertical folders 7, 8, and checking that, at the measured angles m°; n°, the first and second planar vertical folders 7, 8 are at defined distances d21, d22 from the machine axis 16.

The control conditions described above, stored for example on EPROM, and suitably combined and performed sequentially, permit the creation of a work flow where the operating steps of the effectors, are suitably correlated and sequenced solely on the basis of product size and type of package, the packaging process varying also in accordance with the type of wrapping film used, the perforation lines and the width of the wrapping film reel.

For each different pair of values H and L entered, for example, from a programming terminal 30, the apparatus 20 calculates the most suitable timing for optimum machine operation, adapting the work flow to the product being wrapped, which means that the work flow—unlike that of prior art apparatus—is not specific for a particular product and is optimized each time the wrapping machine is changed over to a different product.

Besides achieving operating flexibility without necessitating manual adjustments and settings of machine timing, the control apparatus according to the invention also optimizes the working conditions of machine parts, particularly of the motors that drive the effectors. In prior art machines, some of the effectors are active only for limited angular steps of the controlling motor and have to be stopped for the angular step remaining to 360°. With the apparatus according to the invention, the only restrictions are the control conditions and the motors 12 of the effectors can be controlled in such a way that they rotate at variable speed, decelerating and accelerating as required, without having to be stopped. This has several advantages. Firstly, the motors that drive the effectors are subjected to less thermal stress. Thus, under equal working conditions for the motors, the productivity threshold achievable by the machine can be raised. Secondly, as motor stopping is no longer an essential part of the process cycle but is required only for safety reasons, braking equipment is reduced in size and power. Since inertia due to acceleration and deceleration is much lower than in process cycles where repeated stopping and starting is required, the power ratings of the motors can be reduced accordingly, which means that construction, operating and maintenance costs are reduced.

The invention described has evident industrial applications and can be subject to modifications and variations without thereby departing from the scope of the inventive concept. Moreover, all the details of the invention may be substituted by technically equivalent elements.

What is claimed is:

1. An apparatus for automatically controlling the work flow of an automatic machine for wrapping cylindrical products (1), the apparatus comprising effectors (2) associated with the machine (2) including: an elevator (3) having a table (4) that is reciprocatingly movable in a vertical direction between a lowered position, in which it receives the products (1) to be wrapped, and a raised position, in which the products (1) are positioned inside a wrapping station (15); a pair of planar horizontal folders (5, 6) located under the wrapping station (15) on each side of a vertical, central machine axis (16), the pair of planar horizontal folders (5, 6) being reciprocatingly movable in reciprocally opposite horizontal directions; and two pairs of planar vertical, parallel folders (7, 8), located on each side of the wrapping station (15) and being reciprocatingly movable in reciprocally opposite horizontal directions; a plurality of pushers (9) positioned in succession at equal intervals along a horizontal direction (10) passing through the wrapping station (15), the pushers (9) being designed to accommodate the products (1) in pairs and to feed them in the horizontal direction (10), and with rotational motors for driving the effectors (2); Said apparatus(20) further comprising electronic storage means (11) having resident functions that relate the angle of rotation a°, b°, c°, c1°, d°, e°, f°, g°, i°, j°, m°, n° described by a controlling motor (12) with the desired instantaneous position of a controlled effector (2); means (13) for detecting the actual instantaneous position of the controlled effector (2); comparator means (14) for determining the positional error of the controlled effector (2) relative to a given expected position upon reaching a certain angle of rotation of the controlling motor (12); and means (25) for controlling the motor (12) of the controlled effector (2), which receive the error signal from the comparator means (14) and apply to the motor (12) a corresponding corrective action designed to control and synchronize the angular position of the controlled motor (12) with that of the controlling motor (12).

2. The apparatus according to claim 1, wherein the functions define a discrete set of control conditions determined as functions of parameters relating to the dimensions of the product (1) to be wrapped.

3. The apparatus according to claim 2, wherein the discrete set of control conditions comprises at least one control condition established between the position of a first planar horizontal folder (5), which is driven towards the machine axis (16) starting from an initial position in which it is away from the axis (16), and the position of the elevator (3) table (4) which moves away from the wrapping station (15) longitudinally along the machine axis (16), this control condition consisting in measuring the angle of rotation (a°) of the controlling motor (12) when the table of the elevator (3) has moved down by a defined vertical distance (h1) and checking that the first planar horizontal folder (5) is at that instant located at a defined horizontal distance (d1) from the machine axis (16).

4. The apparatus according to claim 3, wherein the distance (h1) is nearly equal to the thickness of the first planar horizontal folder (5).

5. The apparatus according to claim 3, wherein the horizontal distance (d1) is substantially equal to (Lp/2), where (Lp) is the width of the table of the elevator (3) measured parallel with the product (1) feed direction in the wrapping station (15).

6. The apparatus according to claim 3, wherein the discrete set of control conditions comprises at least one control condition that establishes a correlation between the location, at th e horizontal distance (d1) of the first planar horizontal folder (5) and the point where a pusher (9) comes into contact with a product (1) inside the wrapping station (15) and thus initiates the motion of the products (1).

7. The apparatus according to claim 3, wherein the discrete set of control conditions comprises at least one control condition established between the position of the second planar horizontal folder (6), which is driven towards the machine axis (16) starting from an initial position in which it is away from the machine axis (16), and the position of the elevator (3) table (4) which is moved away from the wrapping station (15) longitudinally along the machine axis (16), this control condition consisting in measuring the angle of rotation (b°) of the controlling motor (12) when the table (4) has moved down a defined distance (h2) vertically away from the wrapping station (15), and checking that the second planar horizontal folder (6) is at that instant located at a defined distance (d2) from the machine axis (16).

8. The apparatus according to claim 7, wherein the distance (h2) is substantially equal to the sum of the thickness of the first planar horizontal folder (5) plus the thickness of the second planar horizontal folder (6).

9. The apparatus according to claim 7, wherein the distance (d2) is equal to (Lp/2), where (Lp) is the width of the table (4) of the elevator (3) measured parallel with the product (1) feed direction in the wrapping station (15).

10. The apparatus according to claim 3, wherein the discrete set of control conditions comprises at least one control condition established between the position of the first planar horizontal folder (5), which is driven towards the machine axis (16) starting from an initial position in which it is away from it, and the position of the product (1) pusher (9) driven in the horizontal feed direction (10), this control condition consisting in measuring the angle of rotation (c°) of the controlling motor (12) when the first planar horizontal folder (5) has moved past the current position of the pusher (9) by a defined distance (d3), and checking that the first planar horizontal folder (5) has at the same time moved past the first planar vertical folder (7) by a defined distance (d4) measured along the horizontal direction (10) in which the products (1) are fed in the wrapping station (15).

11. The apparatus according to claim 10, wherein the distance (d3) is substantially equal to one half of the overall dimension of the product (1) measured parallel with the horizontal feed direction (10).

12. The apparatus according to claim 10, wherein the distance (d4) is substantially equal to one half of the overall dimension of the product (1) measured parallel with the horizontal feed direction (10).

13. The apparatus according to claim 3, wherein the discrete set of control conditions comprises at least one control condition established between the position of the second planar horizontal folder (6) and the position of the second planar vertical folder (8), both moving towards the machine axis (16), this control condition consisting in measuring the angle of rotation (c1°) of the controlling motor (12) when the second planar horizontal folder (6) is located at a defined distance (d5) from the machine axis (16) and the second planar vertical folder (8) is at a defined distance (d6) from the machine axis (16).

14. The apparatus according to claim 13, wherein the distance (d5) is substantially equal to (Lp/2), where (Lp) is the width of the table (4) of the elevator (3) measured parallel with the horizontal feed direction (10) of the products (1).

15. The apparatus according to claim 14, wherein the distance (d6) is substantially equal to (L/2), where (L) is the distance between two consecutive pushers (9).

16. The apparatus according to claim 3, wherein the discrete set of control conditions comprises at least one control condition established between the position of a pusher (9) touching a product (1) in the wrapping station (15) and the first and second planar horizontal folders (5, 6) moving towards the machine axis (16) and past the machine axis (16) itself, this control condition consisting in measuring the angle of rotation (d°) of the controlling motor (12) when the pusher (9) has moved a defined distance (d7) towards the machine axis (16) and checking that, at the measured angle (d°), the first and second planar horizontal folders (5, 6) have moved past the machine axis (16) by defined distances (d8, d9), respectively.

17. The apparatus according to claim 16, wherein the distance (d7), excluding a constant (K1), is nearly equal to (L/4) where (L) is the distance between two consecutive pushers (9) in the horizontal feed direction (10) of the products (1).

18. The apparatus according to claim 16, wherein the distances (d8, d9) correspond to the end-of-stroke positions of the planar horizontal folders (5, 6) and are substantially equal to one half of the overall dimension of the product (1) measured parallel with the horizontal feed direction (10) of the products (1).

19. The apparatus according to claim 3, wherein the discrete set of control conditions comprises at least one control condition established between the translational motion of a pusher (9) in contact with a product (1) in the wrapping station (15) and the position of the first planar horizontal folder (5) moving away from the machine axis (16) starting from an initial position where the first planar horizontal folder (5) was past the axis (16) and on the other side of it, this control condition consisting in measuring the angle of rotation (e°) of the controlling motor (12) when the pusher (9) has moved a defined distance (d10) away from its starting position and checking that, at the measured angle (e°), the first planar horizontal folder (5) has moved past the machine axis (16) by a defined distance (d11).

20. The apparatus according to claim 19, wherein the distance (d10), excluding a defined constant (K1), is substantially equal to (L/4) where (L) is the distance between two consecutive pushers (9).

21. The apparatus according to claim 19, wherein the distance (d11) is substantially equal to one half of the overall dimension of the product (1) measured parallel with the horizontal feed direction (10) of the products (1).

22. The apparatus according to claim 3, wherein the discrete set of control conditions comprises at least one control condition established between the position of a pusher (9) touching a product (1) in the wrapping station (15), the position of the first planar vertical folder (7) moving forward longitudinally in the horizontal feed direction (10), and the position of the second planar vertical folder (8) moving backwards in the direction (10), this control condition consisting in measuring the angle of rotation (f°) of the controlling motor (12) when the pusher (9) has moved a distance (d12) away from its starting position and checking that, at the measured angle (f°), the first planar vertical folder (7) and the second planar vertical folder (8) have moved defined distances (d13, d14) from the machine axis (16).

23. The apparatus according to claim 22, wherein the distance (d12), excluding a constant (K2), is equal to (L/8) where (L) is the distance between two consecutive pushers (9) in the horizontal feed direction (10) of the products (1).

24. The apparatus according to claim 22, wherein the distance (d13) corresponds to the end-of-stroke position of the first planar vertical folder (7).

25. The apparatus according to claim 22, wherein the distance (d14) corresponds to the end-of-stroke position of the second planar vertical folder (8).

26. The apparatus according to claim 24, wherein the distances (d13, d14) are substantially equal to (⅜ L), where (L) is the distance between two consecutive pushers (9).

27. The apparatus according to claim 3, wherein the discrete set of control conditions comprises at least one control condition established between the translational motion of a pusher (9) acting on a product (1) in the wrapping station (15) and the position of the second planar horizontal folder (6), which, starting from an initial position in which it was past the axis (16) and on the other side of it, is moving back, away from the machine axis (16), this control condition consisting in measuring the angle of rotation (g°) of the controlling motor (12) when the pusher (9) has moved a distance (d15) away from its starting position where it was in contact with the product (1), and checking that, at the measured angle (g°), the second planar horizontal folder (6) is just beginning to move away from the machine axis (16).

28. The apparatus according to claim 27, wherein the distance (d15), excluding a constant (K3), is equal to (L/4) where (L) is the distance between two consecutive pushers (9).

29. The apparatus according to claim 3, wherein the discrete set of control conditions comprises at least one control condition established between the positions of the first and second planar horizontal folders (5, 6) as they move away from each other and away from the machine axis (16), and while the table of the elevator (3) is moving upwards towards the wrapping station (15), this control condition consisting in measuring the angles of rotation (i°; j°) of the controlling motor (12) when the table (4) of the elevator (3) has moved down, away from the wrapping station (15), by a defined vertical distance (h3), and checking that, at the measured angles (i°; j°), the first and second planar horizontal folders (5, 6) are, respectively, at defined distances (d18, d19) from the machine axis (16).

30. The apparatus according to claim 29, wherein the distance (d18), when the table of the elevator (3) is below the first planar horizontal folder (5) by a vertical distance (H), is approximately equal to (L/2), where (L) and (H) are the distance between two consecutive pushers (9) and the height of the product (1), respectively.

31. The apparatus according to claim 29, wherein the distance (d19), when the table of the elevator (3) is below the second planar horizontal folder (6) by a vertical distance (H), is approximately equal to (L/2), where (L) and (H) are the distance between two consecutive pushers (9) and the height of the product (1), respectively.

32. The apparatus according to claim 3, wherein the discrete set of control conditions comprises at least one control condition established between the respective positions of the first and second planar vertical folders (7, 8) as they move away from the machine axis (16) and the upward motion of the table of the elevator (3) towards the wrapping station (15), this control condition consisting in measuring at least one of the angles of rotation (m°; n°) of the controlling motor (12) when the table (4) of the elevator (3) is located at a defined vertical distance (h4) from the lower edge of the planar vertical folders (7, 8), and checking that, at the measured angles (m°; n°), the first and second planar vertical folders (7, 8) are at defined distances (d21, d22) from the machine axis (16).

33. The apparatus according to claim.3, wherein the control conditions are combined in various ways and performed sequentially.

34. The apparatus according to claim 1, wherein the controlling motor (12) is one of the drive motors (12) of the effectors (2).

35. The apparatus according to claim 1, wherein the detecting means comprise encoders (13) associated with the motors (12).

* * * * *